US007475495B2

(12) United States Patent
Chiles et al.

(10) Patent No.: US 7,475,495 B2
(45) Date of Patent: Jan. 13, 2009

(54) DRYNESS SENSOR FOR CLOTHES DRYER

(75) Inventors: Howell H. Chiles, Altoona, IA (US); Timothy E. White, Chubbuck, ID (US)

(73) Assignee: Maytag Corporation, Benton Harbor, MI (US)

( * ) Notice: Subject to any disclaimer, the term of this patent is extended or adjusted under 35 U.S.C. 154(b) by 54 days.

(21) Appl. No.: 11/108,282

(22) Filed: Apr. 18, 2005

(65) Prior Publication Data

US 2006/0230632 A1 Oct. 19, 2006

(51) Int. Cl.
*F26B 19/00* (2006.01)

(52) U.S. Cl. ..... 34/443; 34/528; 34/532; 34/562; 73/73; 307/91; 340/604; 219/213; 219/509

(58) Field of Classification Search ..... 34/380, 34/443, 532, 562, 528, 550; 73/73; 219/506, 219/213, 509; 307/650, 91; 340/604
See application file for complete search history.

(56) References Cited

U.S. PATENT DOCUMENTS

| | | | | | |
|---|---|---|---|---|---|
| 3,702,030 | A | | 11/1972 | Janke | |
| 3,729,833 | A | * | 5/1973 | Janke et al. | 34/531 |
| 4,215,486 | A | | 8/1980 | Heyer | |
| 4,385,451 | A | | 5/1983 | Wesley | |
| 4,385,452 | A | | 5/1983 | Deschaaf | |
| 4,477,982 | A | * | 10/1984 | Cotton | 34/550 |
| 4,531,305 | A | | 7/1985 | Nagayasu | |
| 4,738,034 | A | | 4/1988 | Muramatsu | |
| 5,588,438 | A | * | 12/1996 | McKown et al. | 600/505 |
| 5,737,852 | A | | 4/1998 | Shukla | |
| 5,763,858 | A | * | 6/1998 | Jones | 219/506 |
| 6,047,486 | A | | 4/2000 | Reck | |
| 6,067,845 | A | | 5/2000 | Meerpohl | |
| 6,941,674 | B2 | * | 9/2005 | Park et al. | 34/88 |
| 2004/0036486 | A1 | | 2/2004 | Yang | |
| 2006/0242859 | A1 | * | 11/2006 | Pezier | 34/528 |

FOREIGN PATENT DOCUMENTS

JP 3 56081442 A 7/1981

* cited by examiner

*Primary Examiner*—S. Gravini
(74) *Attorney, Agent, or Firm*—Clifton Green; Michael D. Lafrenz

(57) ABSTRACT

The current invention relates to a clothes dryer having a dryness sensing device and method of use comprising at least two electrically conductive sensor bars placed closely together but not touching one another so that articles in the dryer can contact two of the sensor bars at the same time. At least one sensor bar is electrically connected to an electrical current source and at least one sensor bar is electrically connected to an electrical ground. A microcontroller is electrically connected between the electrical current source and the electrical ground so as to be capable of measuring the voltage across the sensor bars when the sensor bars are contacted by the articles being dried. The microcontroller is configured so as to determine the dryness of the articles by calculating the electrical resistance of the articles by using the value of the voltage across the sensor bars and the value of the current through the sensor bars.

18 Claims, 2 Drawing Sheets

DRYNESS SENSOR FOR CLOTHES DRYER

BACKGROUND OF THE INVENTION

This invention relates to a dryness sensor device and method for a clothes dryer.

Electronic control systems are commonly used on appliances, including clothes washers and dryers to control the operation of the appliance.

Prior art clothes dryers were controlled by a control system which limited the run time of the dryer based solely on time. The dryer would run for a set amount of time, regardless if the clothes inside were dry or not. Today's more energy conscious consumers create a need for more efficient operation of appliances. Therefore, it is desirable to have an appliance such as a clothes dryer appliance which would turn itself off once the items are completely dried.

Dryers having dryness sensors are known. For example, published U.S. Patent Application Publication No. U.S. 2004/0036486 discloses a dryness measurement device for sensing a dryness status of laundry. That invention uses an electrode sensor for sensing the dryness status of the laundry and measuring the current dryness status by a variance of voltage which is charged in a capacitor based on a variance of resistance of the electrode sensor. In other words, to sense dryness, this invention measures the voltage which is charged on a capacitor.

Another example of a drying appliance which uses a sensor for sensing dryness of the articles being dried is shown in U.S. Pat. No. 4,215,486. This patent discloses a storage capacitor charged from a DC voltage source together with the laundry resistance resulting from wet laundry bridging two electrodes and resistance is determined. In order for the system to work, a capacitor must be charged. Thus, it is desirable to have a dryness sensing device which does not rely on the charge stored in a capacitor.

The primary objective of the present invention is to provide an improved dryness sensor device and method for a clothes dryer.

A further objective of the present invention is to provide a drying appliance which effectively senses the dryness of the articles being dried.

A further objective of the present invention is the provision of a drying appliance in which the dryness sensor saves energy by shutting down the appliance when the clothes have reached proper dryness.

A further objective of the present invention is to provide a method for drying articles which stops the drying process when the articles reach the proper dryness level.

A further objective of the present invention is a provision of a dryness sensor which is economical to manufacture, durable in use, and efficient in operation.

These and other objects of the invention will be apparent from the specification and claims that follow.

A feature of the present invention involves a dryness sensing device in a drying appliance which uses an integrated circuit which is configured as an application specific integrated circuit.

A further feature of the present invention involves a dryness sensing device in a drying appliance wherein a current source is integrated into an application specific integrated circuit.

A further feature of the present invention involves a dryness sensing device in a drying appliance wherein a current source is configured as a current mirror.

A further feature of the present invention involves a dryness sensing device in a drying appliance wherein a current source is driven by a programmable current source.

A further feature of the present invention involves a dryness sensing device in a drying appliance wherein an op amp and a voltage divider circuit produces voltage input to an analog digital converter from a point electrically between an electrical current source and an electrical ground.

A further feature of the present invention involves a dryness sensing device in a drying appliance configured with at least one electrical resistor in series with a current source and sensor bars.

A further feature of the present invention involves a dryness sensing device wherein at least one sensor bar is electrically connected to an application specific integrated circuit.

A further feature of the present invention involves a method for sensing dryness comprising the step of converting an analog voltage reading which is across at least two sensor bars into a digital signal for input into a microprocessor.

A further feature of the present invention involves a method for sensing dryness comprising the step of using an application specific integrated circuit for calculating the electrical resistance of an article being dried.

SUMMARY OF THE INVENTION

The foregoing objects and features may be achieved by a dryness sensing device in a drying appliance comprising at least two electrically conductive dryness sensor bars placed closely together, but not touching one another, inside the dryer so that articles which are to be dried can contact two of these sensor bars at the same time. At least one sensor bar is to be electrically connected to an electrical current source and at least one sensor bar is to be electrically connected to an electrical ground. A microcontroller is electrically connected between the electrical current source and the electrical ground so as to be capable of measuring the voltage across the sensor bars when the sensor bars are contacted by the articles being dried. The microcontroller is configured within an integrated circuit and further configured so as to determine the dryness of the articles being dried by calculating the electrical resistance of the articles being dried by using the voltage across the sensor bars and the current through the sensor bars.

The method for sensing dryness according to the present invention comprises the steps of allowing an article which is being dried to contact at least two dryness sensor bars, creating an electrical current from an electrical current source through one sensor bar, through the article which is being sensed, and through the other sensor bar, and then to electrical ground, then measuring the electrical voltage across the two sensor bars which are being contacted by the article. The next step is calculating the electrical resistance of the article being dried by dividing the voltage across the two sensor bars by the current through the sensor bars and the article being dried.

DETAILED DESCRIPTION OF THE PREFERRED EMBODIMENT

The present invention is directed to an improved laundry drying appliance having a dryness sensor and method of sensing dryness in the articles being dried in the appliance.

Figure 1:
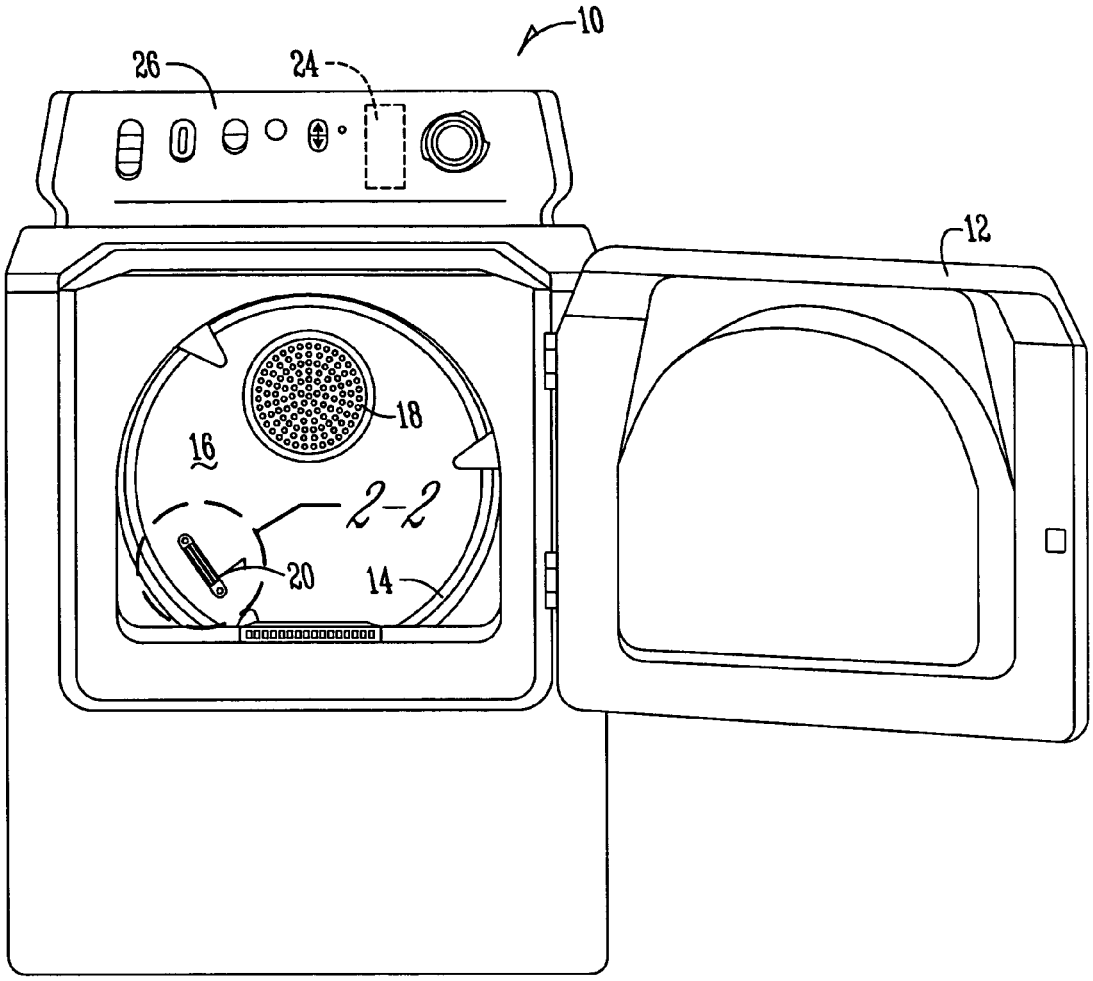
FIG. 1 shows a dryer having a pair of dryer sensor bars incorporated into the appliance.
Figure 2:
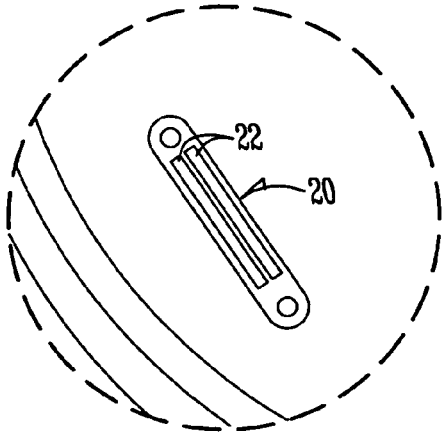
FIG. 2 is an enlargement of the area circled by the line 2-2 in FIG. 1.

FIG. 1 shows a clothes dryer 10 having a door 12 that is capable of being opened to allow a user to insert the items which are to be dried into a rotatable drum 14 of the appliance 10. The drum 14 has a stationary back wall 16 with a perforated plate 18 through which heated air is introduced into the drum 14.

The drum 14 includes a dryness sensor assembly 20, comprising at least two dryness sensor bars or electrically conductive electrodes 22 located relatively close to one another. Any electrically conductive material can be used for the dryness sensor bars 22. Preferably, the dryness sensor bars 22 are rust-resistant, such as stainless steel.

The dryness sensor assembly 20 can be placed anywhere inside the drying appliance 10 so that articles which are to be dried by the drying appliance 10 regularly contact the bars or electrodes 22 during normal operation of the appliance 10. This contact of the articles which are to be dried in the drying appliance 10 allows an electrical voltage potential across the dryness sensor bars 22 so that when the article to be dried or sensed contacts two of the sensor bars 22, an electrical current flows between the contacted sensor bars 22.

The articles, such as clothes, being dried in the dryer 10 have an electrical resistance when wet, which allows electrical current to flow easily through the article and thus creates an electrical voltage potential across the bars 22. As the articles dry, the electrical resistance increases relative to the dryness, and as a result, the electrical voltage potential increases across the electrodes 22 supplying electricity to the articles. As a result, a microcontroller 24 in the control panel 26 of the dryer 10 can determine when an article is increasing in electrical resistance and thus is approaching a dry state. When the article reaches the desired dryness point, the drying appliance 10 can then be shut down which results in energy savings.

Figure 3:
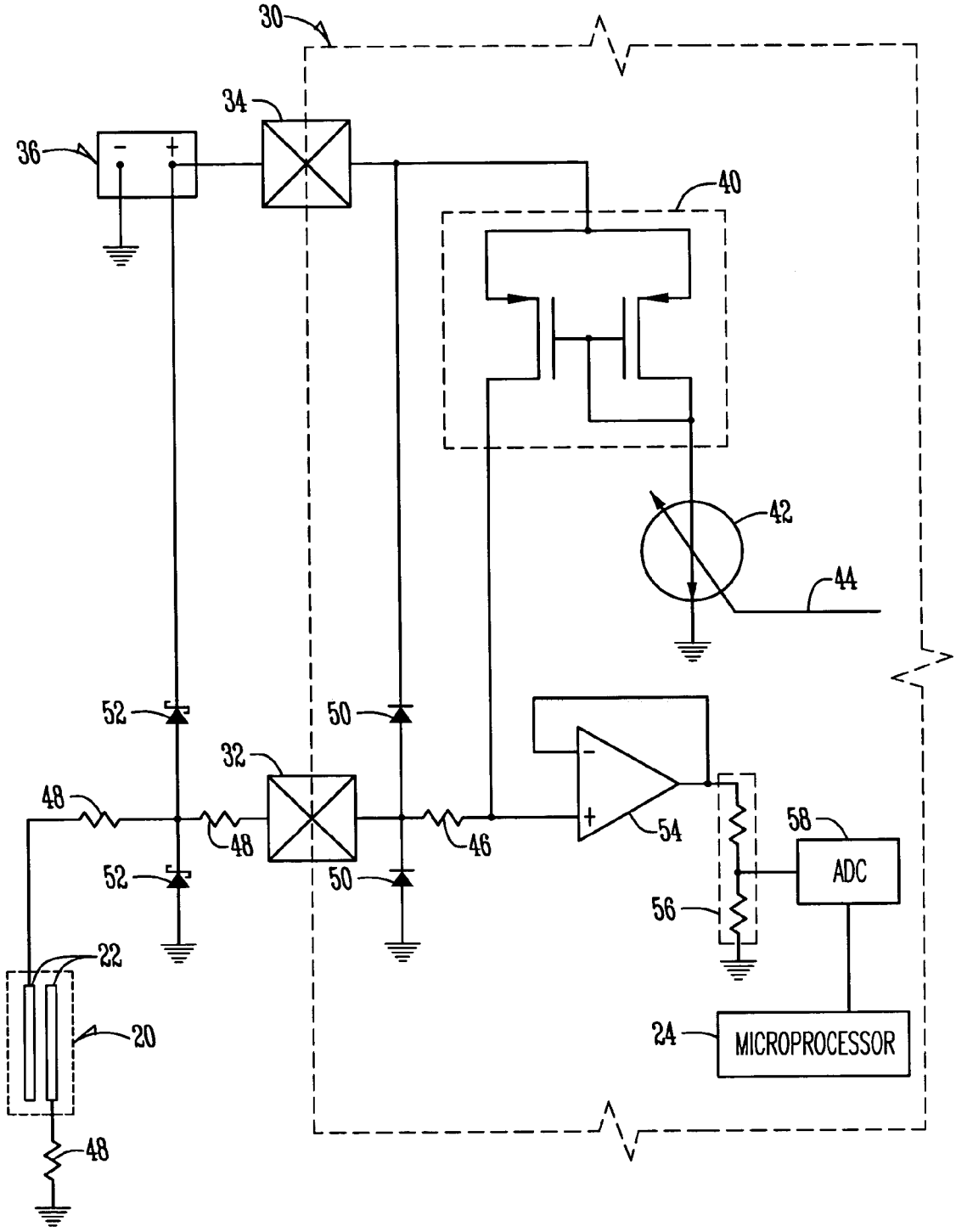
FIG. 3 shows one embodiment of an electrical circuit for implementing the current invention.

FIG. 3 shows an electrical schematic for one embodiment of the present invention. A portion of an application specific integrated circuit (ASIC) 30 contains some of the components comprising this embodiment of the invention and may contain the microprocessor 24. Two of the pins of the ASIC 30 are shown, the DRYNESS SENSOR terminal 32 and the POWER SUPPLY terminal 34. These terminal points 32 and 34 allow for external components to be connected to the integrated circuit 30.

A 12 volt DC power supply assembly 36 is shown in the circuit connecting to the terminal 34. The 12 volt DC power supply 36 helps power the circuit for the present invention.

The circuit is driven by a programmable current source 42. The programmable current source 42 is switched between high and low current output with the current source enable 44. A microcontroller switches the current source enable 44 between digital 0 and digital 1. A digital 0 represents low current output for the programmable current source 42. Digital 1 represents high current output for the programmable current source 42.

The programmable current source 42 drives a current mirror 40. The preferred current mirror 40 of this invention uses MOSFET technology. However, other current mirrors can be utilized for this invention. Because this is a current mirror 40, the current on one side of the current mirror is forced to be identical to the current on the other side of the current mirror. Because the gates and the drains are tied to the same electrical points respectively, the current going through each side of the current source 40 or each MOSFET in the current source 40 is forced to be the same value as the current in the other MOSFET.

The current flowing from the current mirror 40 flows through the buffering resistor 46 and out of the ASIC 30 at the terminal 32. The buffering resistor 46 is designed so as to isolate the circuitry within the ASIC 30 from the outside circuitry connected to the ASIC 30 at the terminal 32.

The diodes 50 and the Schottky diodes 52 are used to protect the circuit from electrostatic discharge (ESD). Schottky diodes 52 are used on the external circuitry components so that they trigger faster than the internal diodes 50 which are located in the ASIC 30. This enhances protection of the ASIC 30. The protection resistors 48 aid in the dryness sensing and also in the ESD protection. Therefore, if a user touches the bars 22 and they have a large electrostatic charge on the body, the circuitry within the ASIC 30 will not be damaged.

In operation, a constant current source 40 will supply current through protection resistors 48 and dryer sensor bars 22. As items to be dried touch across the sense bars 22, the electrical resistance will vary in the items which are being sensed, depending on the moisture content in the items being sensed. A constant current through this varying resistance will change the voltage into a gained stage. It is preferred that the gain signal will feed into an analog digital converter (ADC) through an internal multiplexer in the integrated circuit 30.

Electrical voltage potential across the dryness sensor assembly 20 is read by the op amp 54. The op amp 54 helps to isolate the analog to digital converter (ADC) 58 and also reduces the voltage so as not to damage the ADC 58. In addition to the op amp 54, the voltage divider 56 further reduces the voltage which is read by the ADC 58. The ADC 58 converts the analog voltage signal to a digital signal. This signal is then input via a data bus into the microprocessor 24 for performing calculations. The calculations which are performed calculate the resistance value of the articles which are placed across the dryness sensor assembly 20 which contact the dryness sensor bars 22. The resistance value of the articles is found by taking the voltage read by the op amp 54 and converted by the ADC 58 and dividing that number by the current which is flowing through the current mirror 40.

Thus, the clothes dryer 10 uses the ASIC 30 with the resistors 48 in series with the electrode sensor bars 22, to determine the moisture content of the clothes or laundry by supplying a constant electrical current to the resistor 48 and sensor assembly 20, and then measuring the voltage across the sensors 22. From the resistance calculations, the resistive value is known for the articles which are contacting the dryness sensor bars 22. By knowing the electrical resistance value of the articles which contact the dryness sensor bars 22, the microprocessor 24 can determine the amount of dryness or wetness of those articles. By knowing the dryness or wetness of the articles, the operation of the drying appliance 10 can be controlled to shut off when the articles being dried have reached proper dryness. The higher the electrical resistance value of the articles being sensed, the dryer the articles are. In addition to sensing the voltage across the dryness sensor bars 22, the ASIC 30 can sense how long the articles which are being sensed are in contact with the sensor bars 22.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A dryness sensing device for use in a laundry drying appliance comprising:

two closely spaced electrically conductive dryness sensor bars, inside the drying appliance so that articles which are to be dried inside the drying appliance can contact both of the sensor bars at the same time;

a current mirror configured to provide constant electrical current;

the sensor bars being electrically connected between the current mirror an electrical ground; and a microcontroller electrically connected between the current mirror and the electrical ground, the microcontroller taking a measurement of a voltage across the sensor bars when the sensor bars are contacted by articles being dried, the microcontroller further determining the dryness of the articles being dried in the drying appliance by calculating an electrical resistance of the articles by dividing a value for the measured voltage across the sensor bars by a value for the constant electrical current through the sensor bars.

2. The dryness sensing device of claim 1 wherein the microcontroller is within an application specific integrated circuit (ASIC).

3. The dryness sensing device of claim 2 wherein the current source is integrated into the ASIC.

4. The dryness sensing device of claim 1 wherein the current source is a programmable current source.

5. The dryness sensing device of claim 1 wherein an op amp and a voltage divider circuit reduce voltage input to an analog to digital converter (ADC) from a point electrically between the electrical current source and the electrical ground.

6. The dryness sensing device of claim 1 further configured with at least one electrical resistor in series with the current source and the sensor bars.

7. The dryness sensing device of claim 1 further comprising a protective resistance in series with the sensor bars.

8. An improved clothes dryer having a rotatable drum for holding clothes to be dried, the improvement comprising:

first and second electrodes connected to a current mirror and an electrical ground, respectively, the current mirror configured to provide a constant electrical current; and a microcontroller electrically connected between the current mirror and the electrical ground, the microcontroller reading the voltage across the electrodes when the electrodes are simultaneously contacted by an article being dried, the voltage indicative of dryness of the clothes.

9. The improved dryer of claim 8 further comprising a protective resistor in series with the electrodes.

10. The improved dryer of claim 8 wherein the current mirror is a programmable current source.

11. The improved dryer of claim 8 wherein the first and second electrodes are electrically connected to an application specific integrated circuit (ASIC).

12. A method for sensing dryness in articles in a clothes dryer comprising the steps of:

allowing an article which is to be dried to contact two dryness sensor bars in the dryer;

creating a constant electrical current from an electrical current source configured as a current mirror, through one sensor bar, through the article which is being sensed, then through the other sensor bar, and then to electrical ground;

measuring the electrical voltage across the two sensor bars which are being contacted by the article; and calculating the electrical resistance of the article using an application specific integrated circuit (ASIC) by dividing the value of the voltage across the two sensor bars by the value of the constant current through the sensor bars and the article.

13. The method of claim 12 further comprising the step of converting an analog voltage reading which is read across the two sensor bars into a digital signal for input into a microprocessor.

14. The method of claim 12 further comprising providing a resistor in series with the sensor bars.

15. The method of claim 14 further comprising measuring the change in voltage across the electrodes.

16. The method of claim 12 wherein dryness of the articles is determined without counting input signals generated by the voltage measurement.

17. The method of claim 13 wherein the microprocessor does not count the input signals.

18. A dryness sensing device for use in a laundry drying appliance, comprising:

first and second electrically conductive dryness sensor bars, inside the drying appliance such that articles which are to be dried inside the drying appliance can contact both of the first and second electrically conductive dryness sensor bars;

a current mirror configured to provide constant electrical current;

a microcontroller electrically connected to the current mirror;

wherein resistance across the sensor bars alters voltage at the microcontroller such that the voltage at the microcontroller being indicative of dryness of the articles and the microcontroller being adapted to calculate a measure of the dryness of the articles from a value of the voltage and a value of the constant electrical current.

* * * * *